United States Patent [19]

Igarashi et al.

[11] Patent Number: 4,792,723

[45] Date of Patent: Dec. 20, 1988

[54] DISPERSIVE TYPE ELECTROLUMINESCENT PANEL AND METHOD OF FABRICATING SAME

[75] Inventors: Masami Igarashi; Yoshinori Kato; Yoshimi Kamijo, all of Furukawa, Japan

[73] Assignee: Alps Electric Co., Ltd., Japan

[21] Appl. No.: 42,610

[22] Filed: Apr. 22, 1987

Related U.S. Application Data

[63] Continuation of Ser. No. 616,724, Jun. 4, 1984, abandoned.

[30] Foreign Application Priority Data

Jun. 4, 1983 [JP] Japan ..... 58-98769

[51] Int. Cl.[4] ..... H05B 33/26; H05B 33/10

[52] U.S. Cl. ..... 313/503; 313/506; 313/511; 427/66

[58] Field of Search ..... 313/503, 506, 511; 427/66

[56] References Cited

U.S. PATENT DOCUMENTS 2,983,837 5/1961 Mash ..... 313/509

3,315,111 4/1967 Jaffe et al. ..... 313/511 X

FOREIGN PATENT DOCUMENTS 57-194485 4/1981 Japan .

*Primary Examiner*—David K. Moore

*Assistant Examiner*—K. Wieder

*Attorney, Agent, or Firm*—Guy W. Shoup; Paul J. Winters

[57] ABSTRACT

A dispersive type flexible luminescent base plate having a transparent electrode formed on one side of the plate, a layer of phosphor applied to the transparent electrode, and a second, flexible electrode disposed opposite to the transparent electrode. The base plate consists of film of synthetic resin. The second electrode is a lamination that consists of a conductive layer disposed on the phosphor layer side and a layer of a low resistance disposed on the external side. The conductive layer consists principally of conductive fine particles.

8 Claims, 1 Drawing Sheet

DISPERSIVE TYPE ELECTROLUMINESCENT PANEL AND METHOD OF FABRICATING SAME

This is a continuation application from application Ser. No. 616,724 filed June 4, 1984, now abandoned.

FIELD OF THE INVENTION

The present invention relates to an electroluminescent panel and a method of fabricating same.

BACKGROUND OF THE INVENTION

A phosphor layer consisting of ZnS or ZnSe and containing a small amount of an activator such as Mn or Cu emits light when it is sandwiched between opposed electrodes (one of which is transparent) and a certain voltage is applied between the electrodes. A surface-area light source utilizing this phenomenon known as "electroluminescence" is called an electroluminescent panel.

Electroluminescent panels are classified as dispersive type or thin film type according to the manner of formation of the phosphor layer. Further, they are classified as DC type or AC type according to the manner in which the panel is excitated.

The aforementioned dispersive type is produced by dispersing fine powder of ZnS or ZnSe containing a small quantity of Mn or Cu in a solution of an organic binder to form a paste, and then applying the paste to a transparent electrode by screen printing, with a doctor knife, or by other means to form a phosphor layer. The thin film type is produced by forming a phosphor layer making use of a thin film formation technique such as evaporation or sputtering. The above-mentioned DC type and AC type are devices which are driven by a DC power supply and an AC power supply, respectively. The present invention pertains to the dispersive type electroluminescent panel.

Referring now to FIG. 1, there is shown a conventional dispersive, DC type electroluminescent panel in cross section. This panel includes a transparent base plate 1 made of glass or similar material, a transparent electrode 2 formed on the plate 1, and a phosphor layer 3 formed on the electrode by painting operation. Another electrode 4 which is opposed to the electrode 2 with the layer 3 therebetween is formed into a thin film from a metal such as aluminum by evaporation or sputtering.

When a DC voltage is applied between the electrodes 2 and 4, a large current flows across them initially, but light emission does not occur. As the voltage is increased gradually without changing any other parameter, the current produced reduces, and when the voltage exceeds a certain value, light emission takes place. This process is known as forming. After the occurrence of forming, the device emits light whose color is characteristic of the activator contained in the device, while consuming a minute electrical current.

Unfortunately, this dispersive type electroluminescent panel has the following disadvantages. The junction where the phosphor layer 3 and the electrode 4 of the panel are in contact with each other is shown in FIG. 2 in enlarged cross section. In many cases the electrode 4 does not sufficiently conform to the surface unevenness of the phosphor layer 3. The layer 3 of the dispersive type panel is formed by applying phosphor powder paste and drying it, as mentioned above, and therefore the air bubbles within the paste and formation of larger particles due to flocculation of the particles of the phosphor 5 make the surface considerably uneven. Meanwhile, since the electrode 4 is a metal thin film formed by evaporation or other means, it lacks flexibility and adhesion, producing a number of gaps 6 between the phosphor layer 3 and the electrode 4. This reduces the area of contact between the layer 3 and the electrode 4, so that the resistance between the electrodes 2 and 4 increases, thus increasing the forming voltage. The result is that the panel generates much heat during the forming, increasing the temperature of the transparent electrode 1° to 100° C. or more. For this reason, when the transparent plate 1 is made of a flexible synthetic resin film, the plate 1 will deform. Further, cracks will be produced in the electrode 2 formed on the plate 1, thereby breaking the electric wires. In the worst case, the panel itself may be burned. As such, the material that can be used for the transparent plate 1 of this kind of electroluminescent panel is only glass or the like and so it is impossible to obtain a flexible electroluminescent panel. In addition, the voltage at the end of the forming is high, requiring a high excitation voltage. Furthermore, if there exist gaps 6 as observed above, the corresponding portions fail to emit light, leading to a decrease in the luminance.

In an attempt to cause the electrode which is opposite to the transparent electrode to adhere to the phosphor layer, it has heretofore been proposed to introduce an adhesive layer made from a conductive resin between them, the resin consisting of a hot melt resin to which conductive fine particles such as carbon are added. Conductive resin adhesives contain a large portion of thermoplastic synthetic resin, or binder component, in the adhesive layer to increase the adhesion. Conductive fine particles are mainly linked together, resulting in electrical conductive property. The resin penetrates into the gaps in the chain-like structure. Consequently, the layer of the conductive resin adhesive exhibits a high electrical resistance ranging from hundreds of ohms to thousands of ohms, though the material is termed a "conductive" resin. The high sheet resistance prevents the forming from proceeding uniformly and creates a difference in the forming velocity between the edge portion of the light emitting surface and the central portion, thus frequently causing uneven emission of light. Thus, it is difficult to obtain a homogeneous emission of light over a large area. Additionally, a high voltage is needed to drive the device.

When the layer of the conductive resin adhesive is stuck to the phosphor layer, the phosphor layer is heated to soften and fuse it, but the high viscosity of the adhesive prevents it from penetrating into minute gaps in the surface of the phosphor layer, whereby contributing to uneven emission of light.

SUMMARY OF THE INVENTION

It is an object of the present invention to provide a dispersive type electroluminescent panel which is free of the foregoing difficulties with the prior art technique and which can exhibit flexibility so that it can deform or bend.

It is another object of the invention to provdde a method of fabricating such an electroluminescent panel.

These objects are achieved in accordance with the teachings of the present invention by providing an electroluminescent panel which comprises a flexible base plate made of a synthetic resin film, a transparent electrode formed on one side of the base sheet, a layer of phosphor formed on the electrode by painting operation, and a second electrode which is opposed to the transparent electrode with the phosphor layer therebetween. The second electrode is a lamination consisting of a conductive layer disposed on the phosphor layer side and a low-resistance layer stacked on the conductive layer on the external side. The conductive layer consists principally of conductive fine particles, most of which are in contact with one another in three-dimensional manner to form electrically conductive paths. The particles penetrate into minute gaps in the surface of the phosphor layer.

The conductive layer where the conductive fine particles are in contact with one another in a three-dimensional way and in which continuous conductive paths are formed can readily be formed in the manner described below. First carbon fine particles such as graphite are uniformly dispersed and suspended in an organic liquid such as alcohol or a low-viscosity liquid such as water, or preferably a liquid which can easily penetrate into the phosphor layer. This suspension is then applied to the surface of the phosphor layer by an appropriate means such as spraying or dipping. Thereafter, it is dried to form a conductive layer in the form of a thin film. It is possible either to treat the surface of each conductive fine particle with a dispersion assistant such as bonding agent or surface active agent or to add a small amount of a dispersant to the suspension in order to maintain the conductive fine particles well dispersed in the suspension. In cases where the surface is treated with a dispersion assistant or a dispersant is added as described previously, it is important that care is taken so as to permit neither an increase in the viscosity of the suspension nor an increase in the sheet resistance of the conductive layer.

Other objects and features of the invention will appear in the course of the description thereof which follows.

DETAILED DESCRIPTION OF THE INVENTION

Figure 1:
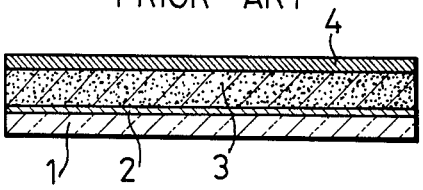
Fig.1 PRIOR ART
FIG. 1 is a fragmentary cross-sectional view of a conventional electroluminescent panel.
Figure 2:
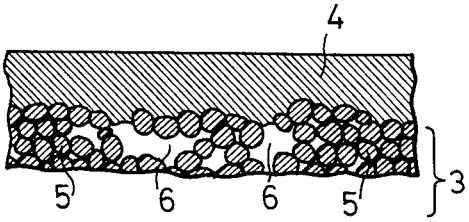
Fig.2 PRIOR ART
FIG. 2 is an enlarged cross-sectional view of a portion of the panel shown in FIG. 1.
Figure 3:
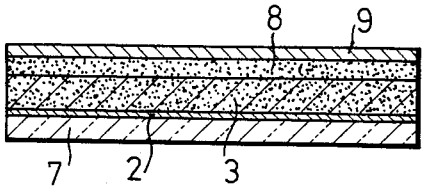
FIGS. 3 and 4 are fragmentary cross-sectional views of electroluminescent panels according to the invention.

Referring next to FIG. 3, there is shown a portion of an electroluminescent panel embodying the concept of the present invention in cross section. This panel includes a transparent base plate 7 as consisting of transparent film which is made from synthetic resin such as polyester or polyimide. A transparent electrode 2 which exhibits a sheet resistance of less than 100 Ω/□ is formed on one side of the plate 7 by a known method. Formed on the electrode 2 is a layer 3 of phosphor which contains fine powder of phosphor as its main component. This powder is fine powder of zinc sulfide which has particle diameters of about 0.5 to 10 μm and which includes about 0.1 to 1.0% by weight of manganese and approximately 0.01 to 0.1% by weight of copper, the zinc sulfide being coated with about 0.1 to 0.8% by weight of copper. A cellulose compound such as ethyl cellulose or nitrocellulose is used as an organic binder. Terpineol or butyl Carbitol is used as a solvent. About 1 to 20% by weight of the organic binder and about 50 to 200% by weight of the solvent are added to the phosphor fine powder, and then these are kneaded to produce paste. This paste is then applied to the transparent electrode 2 by screen printing, with a doctor knife, or other means to form the phosphor layer 3 having a thickness of about 5 to 50 μm.

A conductive layer 8 is formed on this phosphor layer 3. This layer 8 is produced by dispersing fine particles of graphite in an organic liquid such as alcohol, benzene, or toluene, then spraying the liquid against the layer 3, and drying it. Since the liquid penetrates into minute gaps and cracks produced in the phosphor layer 3, the unevenness on the surface of the layer 3 is completely made up by the conductive layer 8. The drying after the application of the liquid causes the dispersion medium to volatilize, and therefore the fine particles of graphite flocculate together, so that most of them are in contact with one another in three-directional manner. Since the conductive layer 8 contains no organic binder as proposed heretofore, the sheet resistance has a quite low value of about 5 to 50Ω. Further, since the graphite constituting the conductive layer 8 takes a form of fine powder, the flatness of the surface of the layer 8 is excellent, and the layer 8 adheres well to a film 9 which is formed by evaporation as described later.

The film 9 which is made from aluminum and has a low resistance is formed by evaporation on the conductive layer 8 in tight contact relation with the layer 8. The layer 8 and the film 9 constitute an electrode which is a lamination opposed to the transparent electrode.

The electroluminescent panel fabricated in this way was sufficiently subjected to forming using a direct current. Then, the luminance of the light emitted by the panel was measured. The result of this measurement is as follows.

| | measurement conditions | | |
|---|---|---|---|
| | DC 50 V | DC 70 V | 50 Hz AC 30 V |
| luminance | 37 cd/m$^2$ | 86 cd/m$^2$ | 43 cd/m$^2$ |

As can be seen from the above table, the novel panel emits satisfactorily intense light when it is excited with alternating current as well as when excited with direct current.

Figure 4:
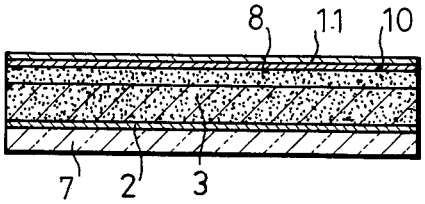

Referring next to FIG. 4, there is shown another electroluminescent panel which is similar to the panel already described except that a layer 10 of a conductive tackiness agent is sandwiched between the conductive layer 8 and a metal foil 11. The layer 10 has been previously formed on the foil side, and urges the foil 11 into sticking engagement with the conductive layer 8. Consequently, the electrode opposite to the transparent electrode consists of three layers, that is, the conductive layer 8, the metal foil 11, and the conductive tackiness agent layer 10. It has been found that this electroluminescent panel emits light of an excellent luminosity in the same manner as in the first-mentioned embodiment.

Since the novel panel according to the invention is constructed as thus far described, the panel itself has flexibility. Hence, it can be deformed into a curved shape, for example, and it can be used in wider applications than conventional. Also, the aforementioned method ensures that the conductive layer penetrating into minute gaps in the surface of the phosphor layer is readily formed. Further, since the film of synthetic resin can be obtained in the form of a long sheet, even as long as tens of meters. Thus, it is possible to use a long length of film directly and continuously while electroluminescent panels are manufactured, thus reducing the loss arising in the course of manufacturing. This also contributes to a reduction in the cost to manufacture such panels.

Obviously many modifications and variations of the present invention are possible in the light of the above teachings. It is therefore to be understood that within the scope of the appended claims the invention may be practiced otherwise than as specifically described.

What is claimed is:

1. In a dispersive type electroluminescent panel of the type having a transparent base plate, a transparent first electrode formed on one side of the base plate, a layer of phosphor applied to the first electrode, and a second electrode disposed opposite to the first electrode in contact with the layer of phosphor therebetween, the improvement comprising said base plate being flexible and made from a synthetic resin, and said second electrode being formed by a conductive layer in contact with said phosphor layer and a low resistance layer adhered to the conductive layer forming an external side of said second electrode, wherein said conductive layer consists substantially only of conductive fine particles which are in contact with one another three dimensionally to form electrically conductive paths such that said conductive layer has a sheet resistance in the range of from 5 to 50 ohms/square, said conductive fine particles being provided to penetrate into minute gaps in the surface of said phosphor layer in order to form a close, continuous electrical contact between said phosphor layer and said second electrode for an even emission of light.

2. A dispersive type electroluminescent panel as set forth in claim 1, wherein the conductive layer does not contain a binder of synthetic resin.

3. A dispersive type electroluminescent panel as set forth in claim 1, wherein the conductive layer is directly applied to the surface of the phosphor layer.

4. A dispersive type electroluminescent panel as set forth in claim 1, wherein the conductive fine particles constituting the conductive layer are graphite.

5. A dispersive type electroluminescent panel as set forth in claim 1, wherein the layer of a low resistance is a metal film which is formed by evaporation.

6. In a dispersive type electroluminescent panel of the type having a transparent base plate, a transparent first electrode formed on one side of the base plate, a layer of phosphor applied to the first electrode, and a second electrode disposed opposite to the first electrode in contact with the layer of phosphor therebetween, the improvement comprising said base plate being flexible and made from a synthetic resin, and said second electrode being formed as a laminate consisting of a conductive layer in contact with said phosphor layer and a low resistance layer adhered to the conductive layer and forming an external side of said second electrode, wherein said conductive layer consists substantially only of conductive fine particles most of which are in contact with one another three-dimensionally to form electrically conductive paths and which penetrate into minute gaps in the surface of said phosphor layer, and wherein the layer of a low resistance consists of a metal foil having a conductive tackiness agent on one side thereof, the layer of a low resistance being stuck to the conductive layer by the tackiness agent.

7. A method of fabricating a dispersive type electroluminescent panel comprising the steps of:

forming a transparent base plate made of synthetic resin and a transparent first electrode on one side of the base plate;

forming a layer of phosphor on the transparent first electrode;

forming a second electrode on the layer of phosphor by spraying a liquid consisting substantially only of an organic solvent in which conductive fine particles are dispersed, and drying the liquid so as to form a conductive layer of substantially only said conductive fine particles in three dimensional electrical contact with one another such that the conductive layer has a sheet resistance in the range of from 5 to 50 ohms/square, and wherein said conductive fine particles penetrate into minute gaps in the surface of said phosphor layer in order to form a close, continuous electrical contact between the phosphor layer and the second electrode; and subjecting said panel and said phosphor layer to electrical forming by applying direct current through said second electrode having the low resistance, conductive layer in close, continuous electrical contact with the phosphor layer.

8. A method according to claim 7, wherein said step of forming a second electrode includes the further step of forming a low resistance layer on the conductive layer by applying a metal foil with adhesive to the conductive layer.

* * * * *